US008997319B2

(12) United States Patent
Jenson

(10) Patent No.: US 8,997,319 B2
(45) Date of Patent: Apr. 7, 2015

(54) CREMATION CASKET

(71) Applicant: Charles T Jenson, Carmel, IN (US)

(72) Inventor: Charles T Jenson, Carmel, IN (US)

( * ) Notice: Subject to any disclaimer, the term of this patent is extended or adjusted under 35 U.S.C. 154(b) by 0 days.

(21) Appl. No.: 14/073,591

(22) Filed: Nov. 6, 2013

(65) Prior Publication Data

US 2014/0123450 A1 May 8, 2014

Related U.S. Application Data

(60) Provisional application No. 61/723,750, filed on Nov. 7, 2012.

(51) Int. Cl.
*A61G 17/00* (2006.01)

(52) U.S. Cl.
CPC ..... *A61G 17/00* (2013.01); *A61G 2017/004* (2013.01)

(58) Field of Classification Search
USPC ..... 27/2, 4, 14, 19; 229/101, 122.21, 229/125.01; 220/8
See application file for complete search history.

(56) References Cited

U.S. PATENT DOCUMENTS

| | | | | |
|---|---|---|---|---|
| 752,159 | A * | 2/1904 | Hamilton | 220/8 |
| 1,076,156 | A * | 10/1913 | Sohierse | 229/101 |
| 4,101,052 | A * | 7/1978 | Dove | 229/101 |
| 4,151,630 | A * | 5/1979 | Havey | 27/2 |
| 5,307,545 | A * | 5/1994 | Stoltz | 27/4 |
| 5,425,163 | A | 6/1995 | Von Braun et al. | |
| 5,661,879 | A * | 9/1997 | Kelly | 27/2 |
| 6,145,275 | A * | 11/2000 | Sweeney | 53/412 |
| 6,154,937 | A * | 12/2000 | Enneking et al. | 27/2 |
| 6,202,270 | B1 * | 3/2001 | Bowman et al. | 27/4 |
| 6,317,944 | B1 * | 11/2001 | Beaulieu et al. | 27/4 |
| 6,557,221 | B2 * | 5/2003 | Cox et al. | 27/4 |
| 6,571,440 | B1 * | 6/2003 | Faulkner et al. | 27/4 |
| 6,694,579 | B2 * | 2/2004 | Belanger et al. | 27/4 |
| 7,003,855 | B2 * | 2/2006 | Lew | 27/4 |
| 7,204,003 | B2 | 4/2007 | Davis et al. | |
| 7,249,403 | B2 * | 7/2007 | Davis et al. | 27/27 |
| 7,263,751 | B2 * | 9/2007 | Davis et al. | 27/4 |
| 7,302,743 | B2 | 12/2007 | Fash | |
| 7,322,079 | B2 | 1/2008 | Davis et al. | |
| 7,350,278 | B2 | 4/2008 | Davis et al. | |
| 8,079,119 | B1 * | 12/2011 | Ferko, III | 27/4 |
| 8,104,151 | B2 * | 1/2012 | Cox et al. | 27/4 |
| 8,375,534 | B2 | 2/2013 | Gesell et al. | |

(Continued)

OTHER PUBLICATIONS

Alternative Container Product Catalogue; Oct. 29, 2013.

(Continued)

*Primary Examiner* — William Miller
(74) *Attorney, Agent, or Firm* — E. Victor Indiano; Indiano Law Group, LLC

(57) ABSTRACT

A cremation casket includes a lid and a base. The base includes a lower member and an upper member. The lower member includes a base panel and at least first and second upstanding side wall panels. The first and second side wall panels are disposed in planes generally perpendicular to a plane in which the base panel is disposed. The upper member includes first and second upstanding side wall panels that are disposed in planes generally parallel to the planes in which the first and second side wall panels of the lower member are disposed. First and second flap panel members are also provided that are movable between the storage position wherein the base has a relatively reduced height and a used position, wherein the base has a relatively enlarged height.

21 Claims, 14 Drawing Sheets

(56) References Cited

U.S. PATENT DOCUMENTS

| | | | | |
|---|---|---|---|---|
| 8,375,535 | B2 * | 2/2013 | Cox et al. | 27/4 |
| 8,739,375 | B2 * | 6/2014 | Centenari | 27/4 |
| 2002/0053120 | A1 | 5/2002 | Cox et al. | |
| 2011/0314647 | A1 | 12/2011 | Jackson | |
| 2012/0084952 | A1 | 4/2012 | Hobstetter | |
| 2014/0026378 | A1 * | 1/2014 | Gessel et al. | 27/4 |
| 2014/0115843 | A1 * | 5/2014 | Jenson | 27/27 |
| 2014/0230203 | A1 * | 8/2014 | Cox et al. | 27/4 |

OTHER PUBLICATIONS

Boxes Unlimited, Inc.; Cremation Containers; May 2, 2011, The Wayback Machine, http://web.archive.org/web/20110502094350/http://boxesunl.com/cremation-boxes.html.

Eternity International Cardboard Casket, Via The Wayback Machine, http://web.archive.org/web/20110930222356/http://www.eeternity.com/Product.html, Oct. 11, 2011.

Starmark Funeral Products; Via The Wayback Machine, http://web.archive.org/web/20090814170559/http://www.starmarkfp.com/kinsmanpage.htmonline store; Aug. 14, 2009.

* cited by examiner

CREMATION CASKET

PRIORITY STATEMENT

The present application claims benefit of Jenson, U.S. Provisional Patent Application No. 61/723,750 that was filed on Nov. 7, 2012 and which is fully incorporated herein.

TECHNICAL FIELD OF THE INVENTION

The present invention relates to funeral products, and more particularly funerary containers for holding the body of a deceased person or animal.

BACKGROUND OF THE INVENTION

After death, it is traditional to place the dead body or corpse into a container. Containers into which bodies are placed take several different forms, and serve several different functions. Often, a flexible, plastic, zipper-containing bag, known as a body bag, is employed to transport a dead body from the place at which a person died, to a body holding or preparation area, such as a morgue or funeral home.

Once at the funeral home or morgue, a body is often placed on a gurney for purposes of performing an autopsy, or for embalming the body. After the autopsy or embalming (or both) is complete, the body is then usually placed in another container. In a large number of cases, the other container into which, the body is placed is a "permanent" casket or coffin, that is suitable not only for holding the body but also for placement into the ground or into a crypt or niche if the body is buried above ground.

Caskets and coffins have been used since at least the time of the ancient Egyptians. To be precise, a coffin and a casket both comprise funerary boxes, although the terms refer to different items in current understanding. A coffin usually refers to a six-sided funerary box whereas a casket refers to a four-sided funerary box. In this application, the term will, be used interchangeably to refer broadly to a funerary box intended to contain a body. Unless otherwise clearly indicated, statements that refer to caskets will also be applicable to coffins.

Current caskets and coffins are made from a variety of different materials, such as wood, metal, and fiberboard. Typically, such permanent caskets have sufficient structural integrity to maintain their rigidity and not bend or collapse when the weight of a body is placed in the casket, and the casket is being transported.

Handles are usually provided on the side of a casket to facilitate the carrying of the casket. These handles are usually secured to the casket by fasteners such as bolts, and the like. Since most permanent caskets are made from a relatively heavy gauge steel, or wood material, most caskets have sufficient structural integrity so that the pall bears can grab the handles, and lift the casket off the bier or hearse deck, and transport the casket by carrying it to a grave or other appropriate place. Because of this structural rigidity, the casket will maintain its generally rectangular, cuboid, box-like shape during such a process, and will not collapse or bend or sag in a manner in which one might expect a less sturdy container to bend or fold when a heavy weight, such as a body, is placed therein.

In addition to the permanent type caskets described above, there is growing use of "temporary" or short-term use caskets, and that are also generally known throughout the industry as "cremation caskets". Cremation involves the placement of a body in an industrial furnace called a cremator, that includes a chamber, called a retort, in which the body is placed for burning. In the retort, the body is burned until the body is reduced to a "powder-like" ash material known as "cremains" that comprise mineral fragments. Since the body is reduced to a few pounds of cremains, there is no need for a permanent casket having sufficient structure and strength to maintain its integrity when buried in the ground for many centuries. Rather, the remaining ashes usually fit into an "urn" that is often the same size as, or smaller than a one pound coffee can.

Actually, the use of a permanent type casket in a cremation setting is counter productive for two primary reasons. The first reason relates to costs. Because of their structural, integrity and decorative aspects, permanent caskets are usually quite expensive. At the time of this writing, the "retail" prices of permanent caskets typically vary from between about $700,00 to $ 15,000.00. It is quite a waste of material and money to employ a $15,000.00 casket for only a four hour viewing, and an hour long church service and then to discard the casket within a retort, where the casket will be effectively destroyed and burned. Reuse of such permanent caskets is also not an option, since reuse of a permanent casket is forbidden unless the interior is completely replaced.

A second drawback with the use of a permanent casket in a cremation process relates to the increased difficulty of burning a permanent casket when compared to the time and energy required to burn only a body. Even though a wood casket will burn quite well, the time required to burn a body in a wood casket to its appropriate "cremains" will often require significantly greater amount of time, and hence, entail a significantly greater amount of costs in fuel materials, such as gas, than a cremation where only a body is burned. A metal casket will likely require an even longer time to be burned completely.

Because of these drawbacks encountered with the use of "permanent caskets", many bodies that are destined for cremation are contained within a "cremation casket". Currently, several types of cremation caskets exist. One factor that governs the particular type of casket used is the cost that the relatives of the deceased are willing or capable of paying for the service and cremation.

A second factor that affects the type of cremation casket employed is whether the cremation casket is going to require decorative aspects. A third factor relates to body weight of the deceased as some cremation caskets must be reinforced in order to properly hold and contain larger bodies of a certain weight or size.

A fourth factor that may affect the choice of a cremation casket relates to transportation. Often, a person will die at a place far removed from the place at which the body is ultimately to be buried. Planes are often employed to transport the body back to the place of burial. To ensure that the integrity of the container is maintained during flights and that the body does not fall out of its container, transporters and shippers often set minimum standards of structural rigidity and integrity that must be met before the transportation carrier will accept the body for transport.

Probably the most simple, and least expensive cremation casket comprises a casket-sized corrugated box. The cremation casket box will typically be constructed similarly to a corrupted box that, is employed to hold a case of copier paper. That is, the box will be a two-piece box, having a base portion that is generally rectangularly cuboid, and an open top; and may have a depth of, for example, about 12 inches. A separable tray-shaped lid having an upper surface and downwardly extending side flanges will have a length and width slightly larger than the base portion of the box, so that the lid can fit over the base portion to cover the open top of the box and so that the downwardly extending flanges of the lid engage the upper portions of the outer side surfaces of the lower base of the box.

A variation of this cardboard box is what might be termed a "viewing cremation casket". At its simplest, a viewing cremation casket is similar to the simple corrugated box disclosed above. However, the viewing cremation casket may include a decorative interior comprising fabric members, pillows and a mattress that are coupled to the interior surface of the box, so that the interior of the cremation casket maintains air appearance similar to that one might expect from a traditional, permanent casket. Additionally, the viewing cremation box/casket may include a "riser" that comprises a secondary bottom member. The height and angle of the secondary bottom can change the angle and height of the body placed thereon relative to the primary bottom, in much the same way that the riser shelf of a permanent casket can adjust the position of a body relative to the bottom member of a traditional casket. By employing a riser, the body can be angled upwardly from the waist in a rested position, so that a body resting within the "viewing cremation box" will have an appearance similar to that one might have if the body were placed in a traditional permanent casket.

The "viewing cremation casket" may be used alone by placing some sort of decorative material or indicia on the exterior surface of the viewing box. Alternately, the viewing cremation casket may be placed within a "rental casket" also known as a re-useable casket. A rental casket is a hybrid-type casket, that generally includes a decorative and structural wall containing outer shell. The outer shell has die structural strength and integrity of a permanent casket, along with the decorative attributes of a permanent casket so that the rental casket has an appearance and transportation functionality of a permanent casket. However, the rental casket also has an undecorated interior that is designed to receive a removable liner, such as the viewing casket box.

Rental caskets are often employed when the family wishes to have a viewing or church service for a deceased soon-to-be-cremated person prior to the actual cremation. Rather than spending the several thousand dollars for a full permanent casket, one can often use the rental casket, by placing a viewing box type cremation casket within the interior of the rental casket. After the viewing and/or services, but prior to cremation, the viewing cremation casket is removed from the rental casket shell, and the cremation casket transported to the crematorium. At the crematory, the viewing type rental casket and body are inserted into the retort, and burned along with the body. The re-useable casket shell can then be fitted with another viewing cremation casket and used for another person.

Another type of cremation casket can be constructed similarly either the viewing casket or the "plain box" cremation casket described above, but includes reinforcement. Often, an inexpensive wood, particle board or plywood member, having dimensions that are sized to permit the reinforcing member to be placed on the bottom interior surface of the cremation box are employed. These reinforcing boards help to reinforce the bottom of the cremation casket, to give it additional strength and rigidity to make it better able to hold the weight of a body, without bending, folding or collapsing. Such reinforcing boards are especially useful and can be necessary in oversized or barriatric caskets that are employed for holding larger individuals.

Since the reinforcing board is disposed interiorly of the casket, and below the drapery and cloth interior of a viewing casket, it is usually not seen by anyone other than the funeral director. Since the wood has no decorative purpose, an inexpensive wood or wood by-product, such as Masonite or particle board can be employed, as there is no need to incur the expense of a more highly decorative finer wood, such as a pine, cherry, oak, teak, walnut or maple.

A fourth, type of cremation casket comprises a "hard board" cremation casket that is constructed from wood, particle board, Masonite or some other material having similar strength, and rigidity properties. A hard board casket is heavier and more durable than a cardboard container, and as such, is more expensive. However, in situations where durability is necessary, such as for bodies that are being transported by airplane or other vehicle to a distant location, the added cost is well justified, as the additional durability is necessary.

These hard board containers are different than traditional, permanent caskets, as they usually have no decorative features. Because they do not have any decorative attributes, these containers can be made reasonably inexpensively and cost-effectively by using a cheaper burnable material, such as particle board, Masonite or plywood, rather than a more expensive furniture-grade wood, of the type typically used in permanent caskets. The use of metal should be avoided, because metal is more difficult to burn than a more burnable material such as wood. A variation of this transport casket is a cardboard casket that is mated to a wooden tray member that underlays the cardboard box, and facilitates carrying and transportation of the casket.

Although the discussion above has largely been directed toward caskets and cremation caskets used in connection with deceased humans, the same basic parameters apply to caskets that are used for deceased animals. Although not all animals are placed in a casket, there is a growing trend among pet owners to have their pets cremated, with the cremains returned to the owner for burial, disposal or repose in the family abode. In such cases, a cremation casket is often employed to serve as a "carrier" for the deceased animal, so that the animal can be transported from the place at which it died to the crematorium. Cremation caskets are also employed to hold the body of the animal when the body is placed in the retort.

One of the difficulties associated with cremation caskets springs from the costs of shipping the caskets from the manufacturer to the funeral home, and storing the caskets at the funeral home or distribution center. Generally, shipping costs are determined by the weight and size (the cubic volume) of the item shipped. The cost of shipping a cremation casket is not impacted significantly by its weight, since a cremation casket, having typical dimensions of 76" in length, 12" in depth, and 24" in width may only weigh 10 to 30 pounds or so. However, the size of the cremation casket will exert a significant impact on its shipping costs, since the hypothetical typical casket has a volume of approximately 12.67 cubic feet.

As cremation, caskets are relatively low cost, high volume items, the cost of shipping a cremation casket from the manufacturer to a distantly located customer can comprise a relatively large percentage of the total cost that the user pays for the cremation casket. Viewed another way, the cost of shipping a cremation casket is often high enough so that a cremation casket manufacturer who is located far away from the end user is often at a significant competitive disadvantage to a more closely located casket manufacturer.

This competitive disadvantage is often great enough so that the distantly located manufacturer cannot compete effectively with a casket manufacturer who is located closer to the end user. Although such cost disadvantages can be overcome to some extent through the use of multiple geographically dispersed manufacturing plants and distribution facilities, these multiple manufacturing-plants can add their own costs and inefficiencies that can economically disadvantage the distantly located manufacturer in a different way.

One way to overcome some of these cost disadvantages is to provide a cremation casket that is moveable and configurable between a relatively compressed "shipping" configuration, and a relatively enlarged "use" configuration. In the use position, the cremation, casket must have a sufficient volume and size to accommodate the body of the deceased. By placing such a casket in its relatively compressed shipping configuration, the volume occupied by the casket can be reduced. If the volume of the casket is reduced, more caskets can be placed in a similarly volumed transport vehicle, when compared to caskets that are placed in the enlarged or use position.

A compressed shipping configuration enables the manufacturer and shipper to place more caskets on a single truck, without adding any significant costs to the trucker for driving the truck between the manufacturer and the user. Ultimately, this results in lowering the impact of shipping cost on the casket price. This lower shipping cost can help to reduce the cost disadvantage that a distant manufacturer might have over a more localized manufacturer and thereby increase the effective size of the market area that a particular manufacturer can serve at competitive prices.

Today, such cremation caskets exist that can be moved between a compressed shipping position, and an enlarged use position. One such casket, is known as the Norwood Rental Casket that is manufactured by York Caskets. Although the Norwood Rental Casket does perform its function in a workmanlike manner, room for improvement exists. In particular, one of the difficulties faced with die use of such a "convertible" cremation casket is that a significant amount of time, effort and energy are required to move or re-configure the cremation casket between its compressed or shipping position, and its expanded or use position.

There has been some resistance to the use of currently known convertible cremation caskets because of the time that is required of the funeral director to make this re-configuration. Another issue that must be faced by the manufacturer of a convertible cremation casket is structural rigidity and integrity, and the ability of the casket to maintain itself within the expanded or use position when so configured in the expanded or use position. The cremation casket is a load bearing device, and will likely be transported after a body is placed in the casket and the casket is placed in its use position. Therefore, the casket must have sufficient structural integrity to enable the funeral director to move the body-containing cremation casket even when the casket is in its expanded or use position without the casket suffering a structural failure.

A third issue that must be addressed is the appearance of the casket when in the use position. As discussed above, cremation caskets are often used as "viewing caskets" that are placed interiorly within a shell "rental casket". As rental casket inserts are often used for viewings, rental casket inserts must be designed to accept the various casket lining materials that are placed in the cremation casket, to give it the appearance of a real or permanent casket. Additionally, the walls of the cremation casket should have a solid appearance, so that, when draped with material, the walls do not appear to be weak or bendable as opposed to the solid and rigid appearance interior of a permanent casket.

One object of the present invention is to provide a casket that is moveable between a compressed, shipping configuration, and an enlarged, use configuration, and that will maintain both structural integrity and aesthetically pleasing characteristics when in the expanded or use position.

SUMMARY OF THE INVENTION

In accordance with the present invention, a cremation casket comprises a lid and a base. The base includes a lower member and an upper member. The lower member includes a base panel and at least first and second upstanding side wall panels. The first and second side wall panels are disposed in planes generally perpendicular to a plane in which the base panel is disposed. The upper member includes first and second upstanding side wall panels that are disposed in planes generally parallel to the planes in which the first and second side wall panels of the lower member are disposed. First and second flap panel members are also provided that are movable between a storage position wherein, the base has a relatively reduced height and a use position, wherein the base has a relatively enlarged height.

Preferably, the first and second flap panels are coupled to the respective first and second side panels of the upper member. The first and second flap members are engagable with the base panel of the lower member for preventing the upper member from moving to the reduced height when the first and second flap panels are in the use position. The base panel preferably includes a plurality of tab receiving apertures, and the first and second flap panels include a plurality of tab members that are configured and positioned for being received in the tab receiving apertures, for maintaining the first and second side panels in an engaged relation to the base panel. The tab receiving apertures are preferably positioned adjacent to the first and second side wall panels of the lower member for maintaining the first and second flap panels in a plane generally parallel to the planes in which the first respective first and second side wall panels of the lower member are disposed.

A strap member preferably includes a first end coupled to the lower member, and a second end coupled to the upper member. The strap member has a predetermined length for limiting the movement of the lower and upper members in an expansionary direction, to prevent the lower and upper members from becoming disengaged from each other.

Preferably, a tray member is also included that has a base panel sized and configured to be placed adjacent to the base panel of the base, to reduce deformation when a body is placed in the cremation casket.

By moving the lower member and upper member relatively away from each other, the flap members can be moved into the use position, wherein the flap members are disposed generally co-planarly with the side panel members. Additionally, when placed in this coplanar relationship, the tab members of the flap members are positioned to be inserted into the slots of the base panel. When in the use position, the height of the base panel member is influenced not only by the height of the fixed side panel members, but also by the height of the flap members.

In a highly preferred typical embodiment, the height of the rigid side panel portion of the upper member is approximately 8" and the height of the flap panel portion is approximately 4". As the general overall height of the entire casket (with lid) is slightly greater than 12", it will be appreciated, that the height of this exemplary cremation casket (including lid) when in the compressed or shipping position is approximately two-thirds of the height of the cremation casket when in the use position.

One feature of the present invention is that the cremation casket of tire present invention can be configured into a shipping position or configuration so as to take up less space than a casket when in the use position or configuration. As discussed above, one preferred embodiment of the cremation casket is approximately 8" in height, when compared to approximately 12" in height of the casket when in the use position. From a volumetric standpoint, this means that three cremation caskets of the present invention, when in their shipping position, take up approximately the same volume required by two cremation caskets that are either non-convertible between a use and shipping position, or that are convertible and placed in their use position.

Another feature of the present invention is that the movement between the storage and use position is almost automatic, in its ability to place the casket in its use position. A tray member is provided with the casket that is disposed interiorly of the upper member, and is placed on top of the base of the lower member, and on top the flap panels of the upper member (when in the storage position).

The cremation casket also preferably includes externally mounted handles to move the cremation casket from its storage position to its use position, the handles are pulled upwardly, while the tray is pushed downwardly. The downward pushing of the tray, when coupled with the upward pulling of the upper portion, causes the flaps portion to pivot from their storage position, in a plane generally perpendicular to the side panel members, to their use position, wherein they are disposed generally co-planarly with the rigid side panel members.

Further pushing the tray downwardly, to a point wherein it engages the upper surface of the base panel of the lower portion also helps to move the distal edges of flap panels outwardly to a position wherein tabs of the flap panel members can engage the tab receiving slots of the base panel. When the tabs so engage the slots, the relative position of the upper and lower members are fixed. The fixed positioning of the tabs and the slots prevents the upper member from moving from its use position back into a collapsed position.

The strap member, discussed above, that couples the upper member to the lower member, helps to prevent the upper and lower members from moving in an expansionary direction to a point wherein the upper and lower members become disengaged thereby preventing the lower member from separating from the upper member.

Additionally, the tray member can include an interlocking portion, at its corner, for interlocking the tray member with the upper member to provide further support and resistance to the movement of the upper member relative to the base member in a collapsing direction.

Other features and advantages of the present invention, will become apparent to those skilled in the art upon a review of the detailed description and drawings provided below.

DETAILED DESCRIPTION OF THE PREFERRED EMBODIMENT

Turning to FIGS. 1-7, a cremation casket 10 of the present invention is shown as including a base assembly 12 and a lid 14. As discussed above, the cremation casket 10 can take on the form of a multi-component cardboard, wood, or particle box, that has a generally overall rectangularly cuboid configuration.

Figure 1:
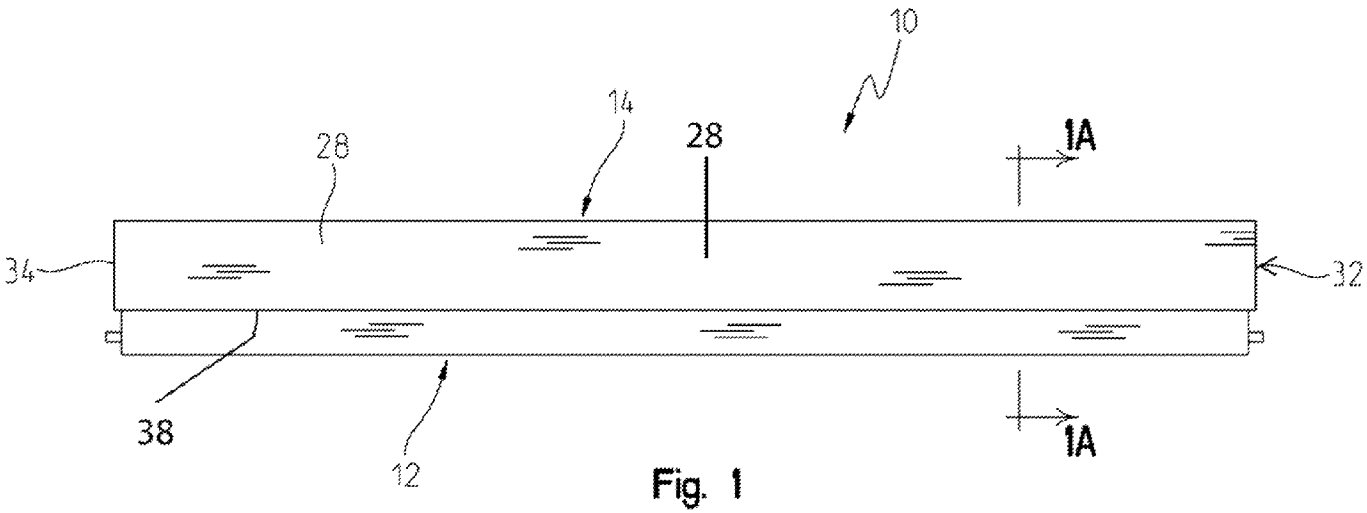
FIG. 1 is a "long side" view of the cremation casket of the present invention in its compressed or "shipping" configuration.
Figure 2:
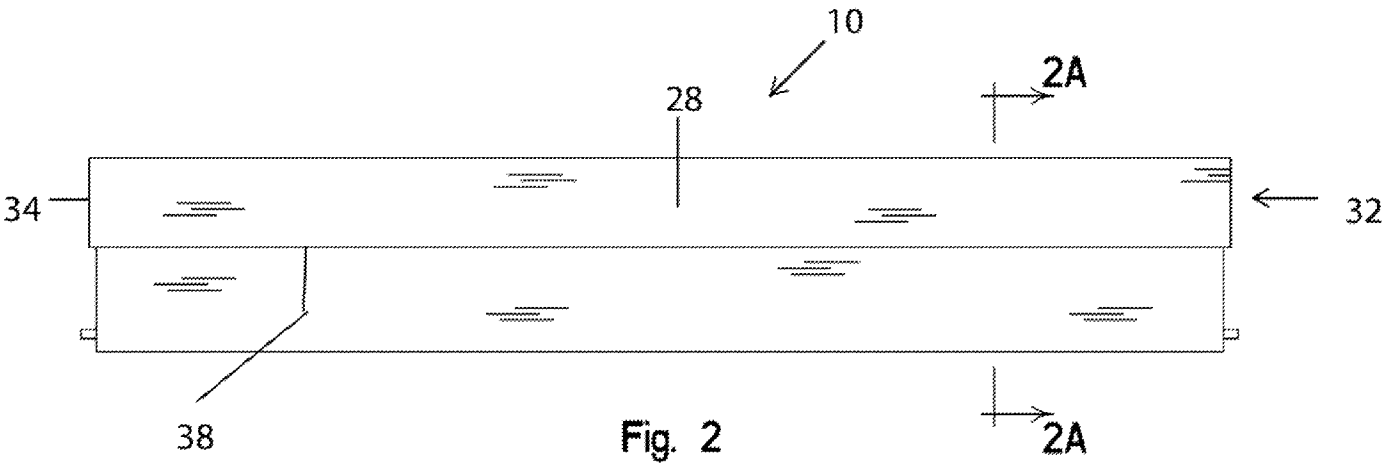
FIG. 2 is a long, side view of the cremation casket of the present invention showing the cremation casket in its expanded or "use" configuration.
Figure 1A:
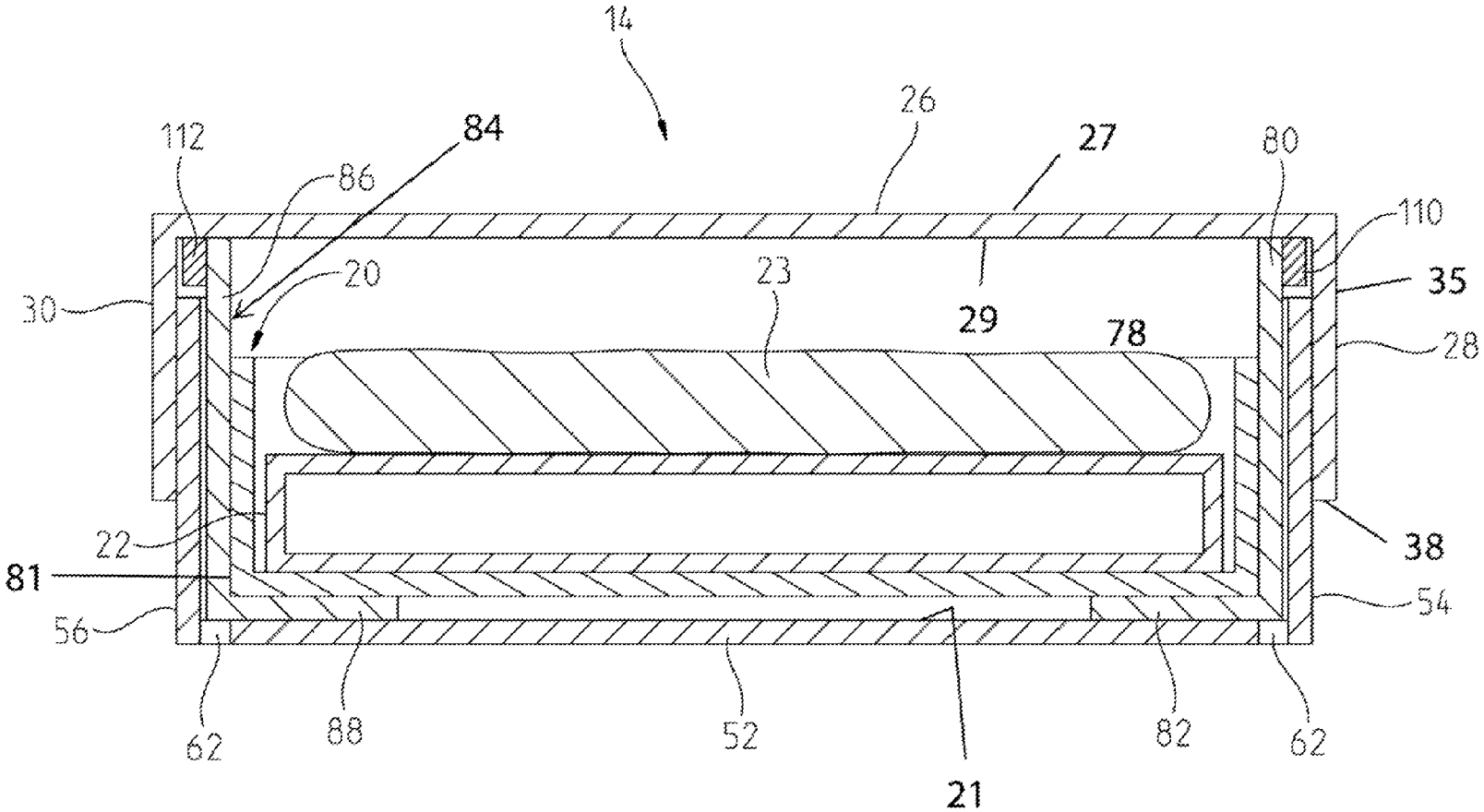
FIG. 1A is a sectional view taken along lines 1A-1A of FIG. 1.
Figure 2A:
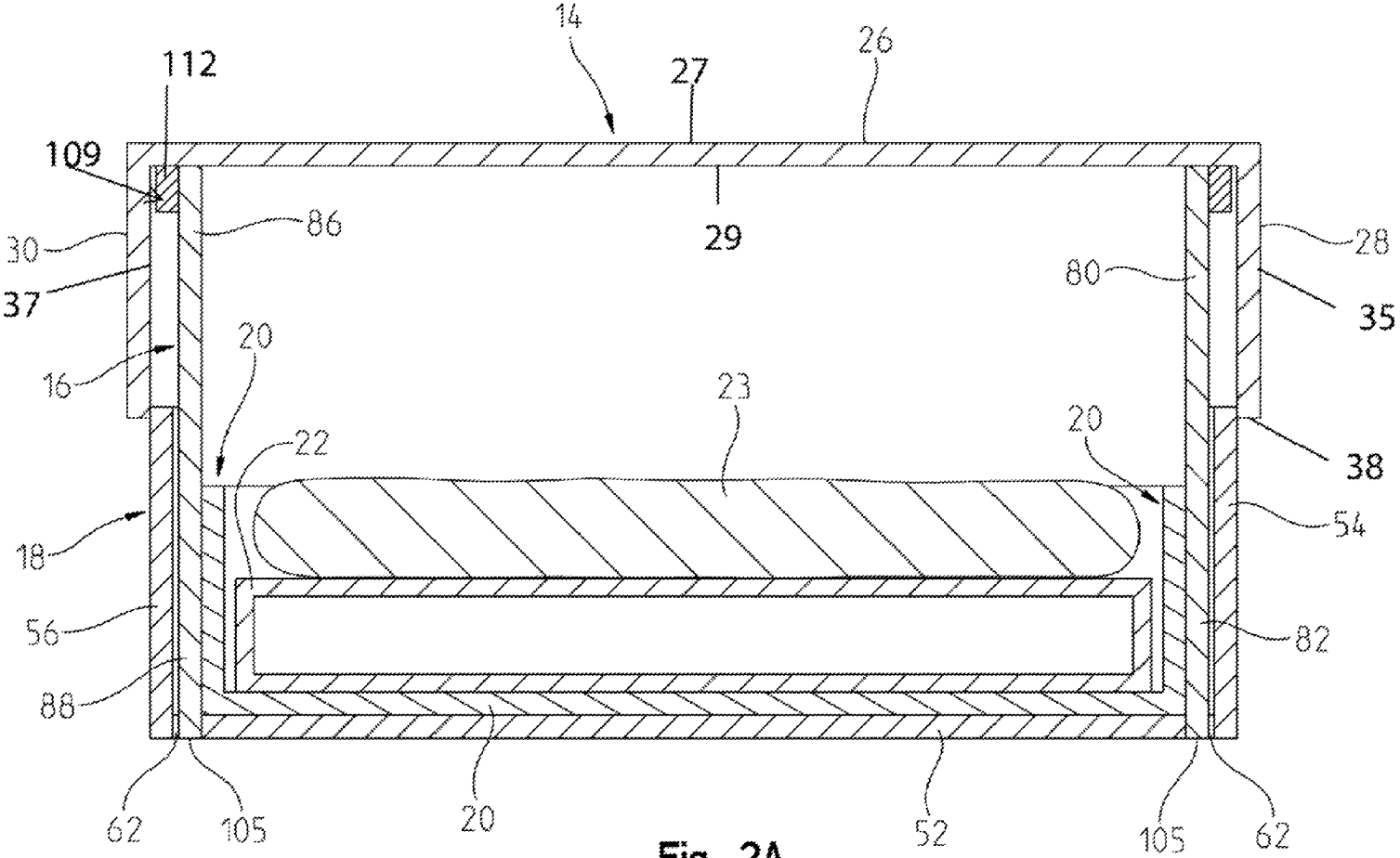
FIG. 2A is a sectional view taken along tines 2A-2A of FIG. 2.
Figure 3:
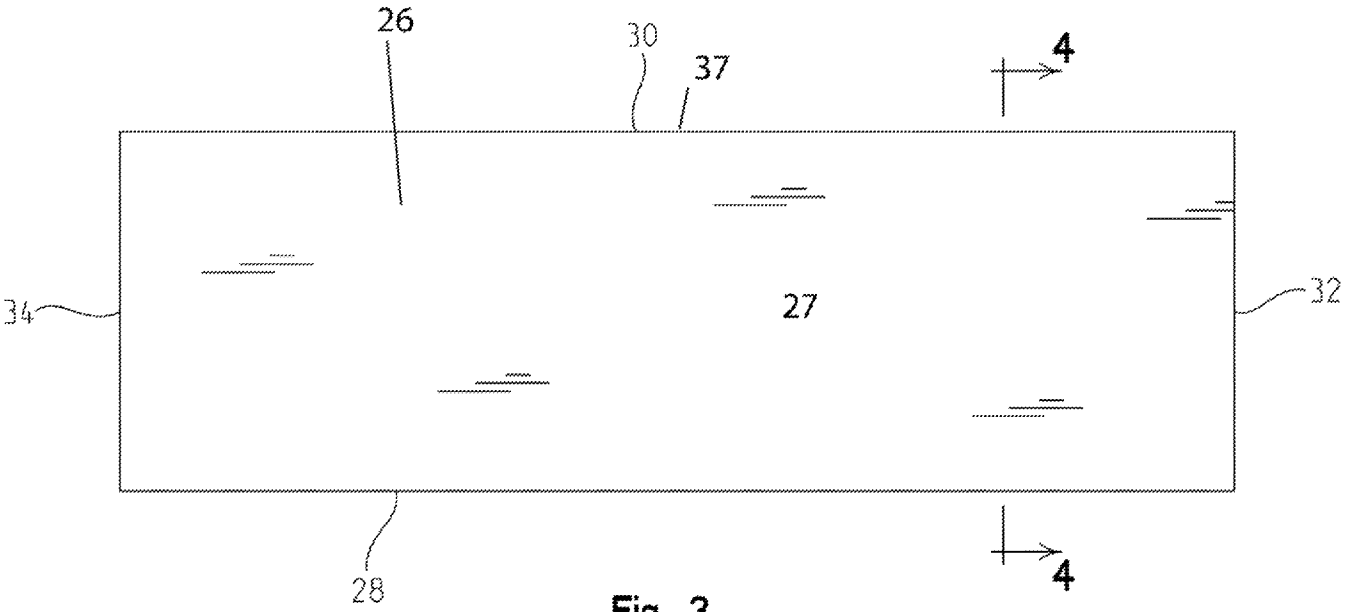
FIG. 3 is a top view of the lid of the cremation casket of the present invention.
Figure 4:
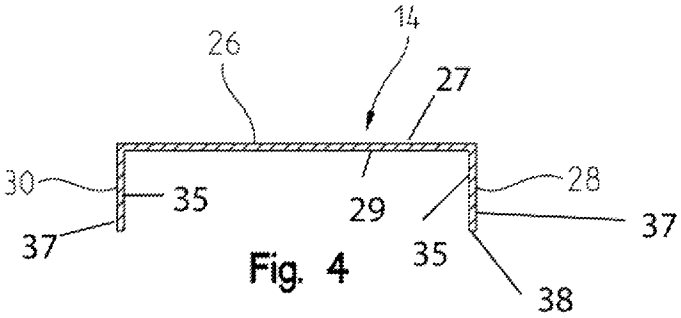
FIG. 4 is a sectional view of the lid taken along lines 4-4 of FIG. 3.

The lid 14 preferably comprises a single member. The base assembly 12 comprises a plurality of components that include an upper member 16 and a lower member 18, a tray member 20 and riser 22. The upper member 16 and lower member 18 are moveable with respect to each other between a compressed or storage (or shipping) position, as shown in FIG. 1 and FIG. 1A, and an expanded or use position as shown in FIGS. 2 and 2A. In the compressed, storage position (FIG. 1), the cremation casket 10 occupies less volume than the volume that it occupies when in the expanded, position, such as is shown in FIG. 2.

The cremation casket can expand to the expanded or use position shown in FIGS. 2 and 2A to provide enough interior volume to enable the casket 10 to fully contain a body having a typical size and weight. Of course, the size of the casket can be reduced to accommodate children and babies, and can be enlarged to accommodate taller and heavier corpses.

In the compressed configuration, shown in FIG. 1 it is likely that the interior volume of the cremation casket 10 will be insufficient for holding a typical body or fitting correctly in a viewing casket as it may not have sufficient depth. Nonetheless, the advantage of the cremation casket 10 in the compressed (storage) position is that since it occupies less volume, it will likely save the manufacturer significant shipping and/or storage costs, due to the reduced volume consumed by the casket 10 in the storage position. In this regard, the most preferred embodiment of the present invention is configured such that the cremation casket 10 when in its storage configuration has a height (and hence volume) that is approximately two-thirds of the volume of the cremation casket 10 when in its use position (FIG. 2).

Therefore, three cremation caskets 10 in their storage configuration (FIG. 1) will occupy generally about the same volume as two cremation caskets 10 (FIG. 2) in their use configuration. Since the primary determining factor that impacts the cost of shipping the cremation caskets 10 is the volume of the casket 10 (due to the light weight of the casket 10), it is believed that the user or manufacturer should be able to reduce his shipping costs by about one-third when shipping the caskets 10 in their storage configuration, as compared to the shipping costs for shipping the cremation casket 10 in its use configuration.

This relatively smaller volume occupied in the use configuration also benefits the funeral director, and distributor. Since the casket 10 occupies less volume when in its storage position configuration, the funeral director can store the cremation casket 10 less expensively due to the lower space requirements afforded by the smaller volume of the casket 10. Additionally, when cremation caskets 10 are stored by a local distributor or logistics company to expedite quick delivery to local funeral directors, the smaller volume occupied by the cremation casket 10 (when in its storage configuration) will reduce storage costs for the distributor since a greater number of cremation caskets can be placed in the same space, or conversely, the space required to store the required number of caskets 10 will be less.

The other two primary components of the base assembly 12 include a tray member 20 and a riser member 22. The tray member 20 (FIG. 7) generally extends throughout the full length of the interior of the cremation casket 10 and is placed against the upper surface 21 of the base panel 52 of the lower member 18 of the base assembly 12. The riser member 22 (FIGS. 15, 16) is placed so that its lower surface 24 (FIG. 15) is placed to rest on the upper surface 25 of the tray member 20 and is generally rectangular when viewed from the top, and triangular in cross-section when viewed from the side. The riser member 22 serves as something of a ramp to help to partially elevate the torso of the deceased person. When the body is placed in the casket, the back and shoulders are placed on the riser so as to cause the torso of the body to be elevated slightly, with the head being placed adjacent to the thickest (highest) part of the riser 22.

As shown in FIGS. 1A and 2A, a cushion member 23 and pillow can be placed on top of the riser 22 and tray 20, to provide a cushion end surface for the body.

Ideally, interior lining and decorative materials, such as cloth side wall, bottom coverings, and the like can be affixed to the interior surfaces of the cremation casket 10, when the cremation casket 10 is used as a viewing casket. These interior materials are employed to create an interior appearance for the casket that is highly similar to the interior appearance of permanent caskets, and are provided to impart a desirable aesthetic appearance to the interior of the cremation casket 10. This aesthetic appearance is especially helpful and useful when the body is going to be displayed at a viewing. In situations where no public display will occur, the family may choose a less expensive cremation casket 10 that does not include these interior treatments.

To better appreciate the interior treatments of the type that might be available, the reader's attention is directed to www.alternativecontainer.com that shows exemplary available materials. In order to simplify the drawings and thereby promote the understanding of the cremation casket of the present invention, the interiors are not shown in most of the drawings. However, these various displays of different interiors shown in the above-referenced site are hereby fully incorporated herein by reference, as exemplary interiors.

The lid 10 of the present invention is best shown in FIGS. 1-4, as including a top panel 26. The top panel 26 has a length in one preferred standard version of about 76.5 inches and a width of about 24.5 inches, so that the lid can interiorly receive the exterior surface of the base assembly 12 of the cremation casket 10 and fit thereover, in a manner generally similar to the way that the lid of a photocopy paper carton fits over the base of the photocopy paper carton. The top panel includes an exterior surface 27 and an interior surface 29.

The lid 14 includes a first long side 28 panel, and a second long side panel 30, disposed adjacent to first and second long side edges of the top panel member 26. Additionally, the lid 14 includes first 32 and second 34 end (short side) panel members, that also are disposed adjacent to first and second end edges of the top panel 26. Each of the side panels 28, 430 and end 32, 34 panels includes an interior surface 35 and an exterior surface 37.

The top panel 26 is disposed in a plane that is generally perpendicular to the plane of each of the side panels 28, 30 and end panels 32,34. The first and second side panels 28, 30 are disposed in parallel planes, and the first and second end panels 32, 34 are also disposed in generally parallel planes. The parallel planes in which the first and second end panels 32, 34 are disposed are generally perpendicular to the parallel planes in which the first and second long side panels 28, 30 are disposed. Each of the side panels 28, 30 and end panels 32, 34 have a depth in a most preferred embodiment of about 8 inches. Each of the side panels 28, 30 and end panels 32, 34 terminate at a lower edge 38. The top panel member 26 in a most preferred embodiment has a length of just slightly longer than about 72 inches in length and 24 inches in width, which is a "typical" size for containing most normal sized adult bodies.

The exterior surfaces 27, 37 of the lid 14 and base assembly 12 can be imprinted with a design or alternately, have a decal applied to the exterior surface to impart a desired aesthetic appearance to the cremation casket 37.

The lower member 18 of the base assembly 12 is best shown in FIGS. 1A, 2A, 7 and 8. The lower member 18 includes a base panel 52 having an exterior surface 40 and an interior surface 21. The base panel 52, and hence the lower member 18 generally has dimensions in a standard embodiment, of approximately 76 inches in length, and approximately 24 inches in width.

The lower member 18 also includes first and second side panels 54, 56 and first and second end panels 58, 60. The first and second side panels 54, 56 are disposed in parallel planes, and are disposed in a plane that is generally perpendicular to the base panel. Similarly, the first and second end panels 58, 60 are disposed in parallel planes to each other. However, the first and second end panels 58, 60 are disposed in planes that are perpendicular to each of the base panel 52, and first and second side panels 54, 56.

Each of the side panels 54, 56 and end panels 58, 60 have a height of about 6 inches in the most preferred embodiment. Each of the side panels 54, 56 and end panels 58, 60 include an interior surface 42, an exterior surface 43, and terminate at an upper edge 44. First 46 and second 47 handles are fixedly coupled to the respective first 58 and second 60 end panels to enable the casket 10 to be gripped to aid transportation and carrying of the casket 10. Reinforcing members, such as wood strips, grommets and the like may be coupled to the end panels 50, 60 adjacent to the handles to prevent the handles 58, 60 from tearing through the cardboard of the end panel.

A plurality of slots including tab receiving side slots 62 and tab receiving end slots 64 are formed in the base panel 52, and are disposed adjacent to the intersection between the base panel 52 and the first and second side panels 54, 56 (for the side slots 62); and also adjacent to the intersection between the base panel 52 and the first and second end panels 58, 60 (for the end slots 64). As will be discussed in more detail below, the side slots 62 and end slots 64 are sized, configured and positioned to receive the tab members 105, 106 that are formed on the lower edge of the flap panels of the upper member 16.

Additionally, a sheet-like reinforcing member (not shown) can be placed over the base panel 52 to overlay its upper surface 25 if additional structural rigidity is necessary to bolster the strength of the base panel 52 to help prevent the base panel 52 from sagging of bending. Preferably the reinforcing member is made either from cardboard, plastic, plywood, partible board or the like, and had length and width dimensions generally similar (but slightly smaller than the base panel; and cut outs that correspond in size and position to the slots 62, 64.

Figure 7:
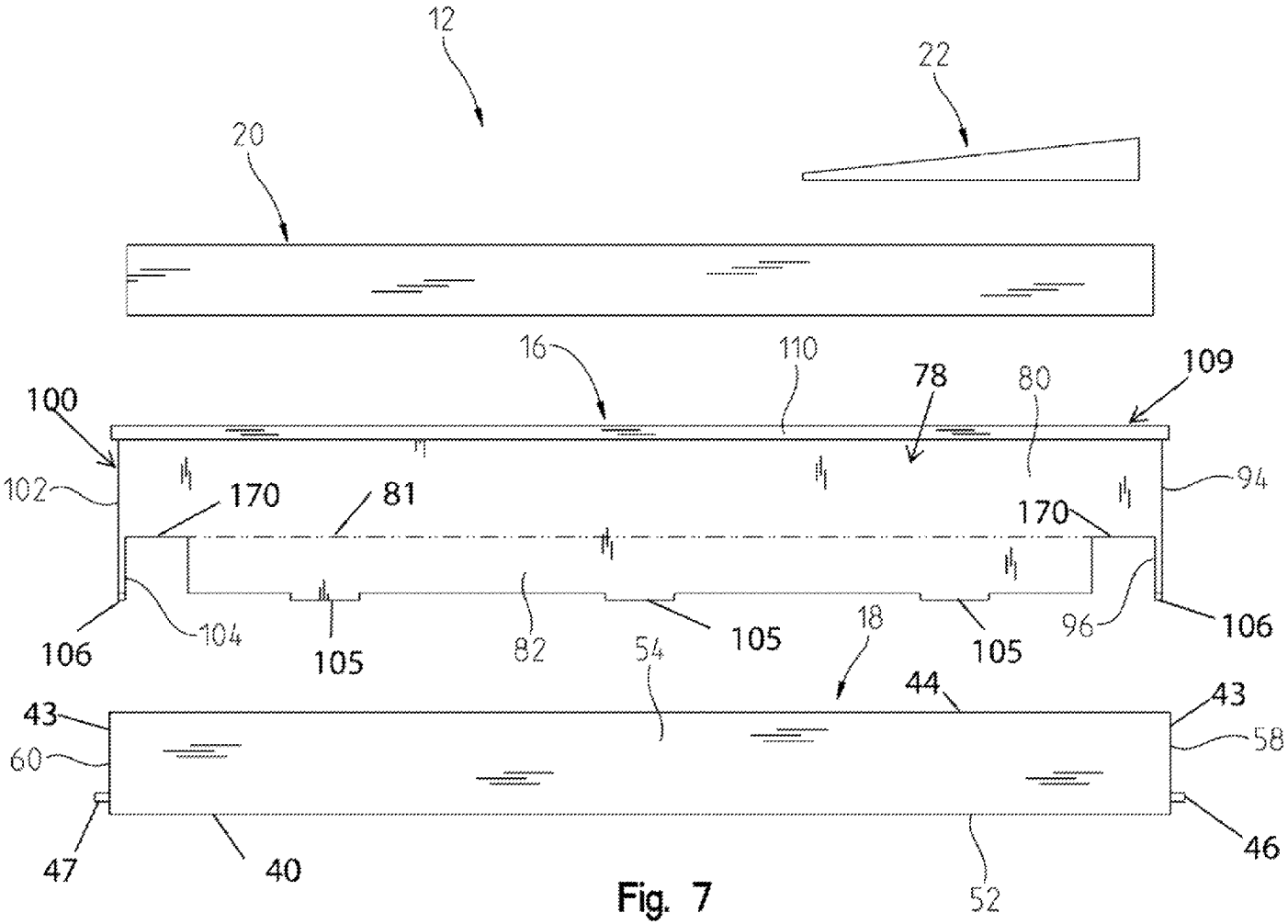
FIG. 7 is an exploded, side view of the components of the lower member of the cremation casket of the present invention.
Figure 8:
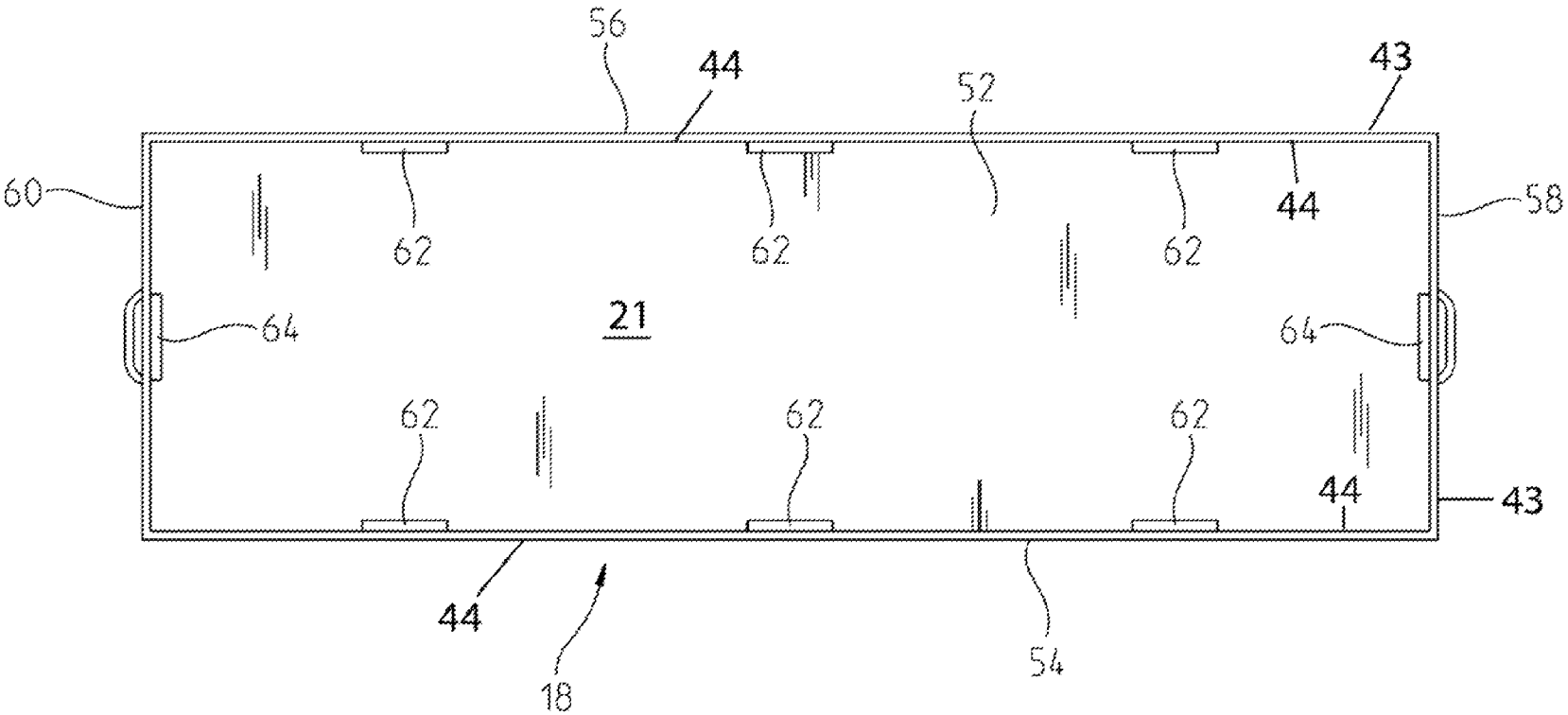
FIG. 8 is a top view of the lower member of the base portion of the cremation casket of the present invention.
Figure 9:
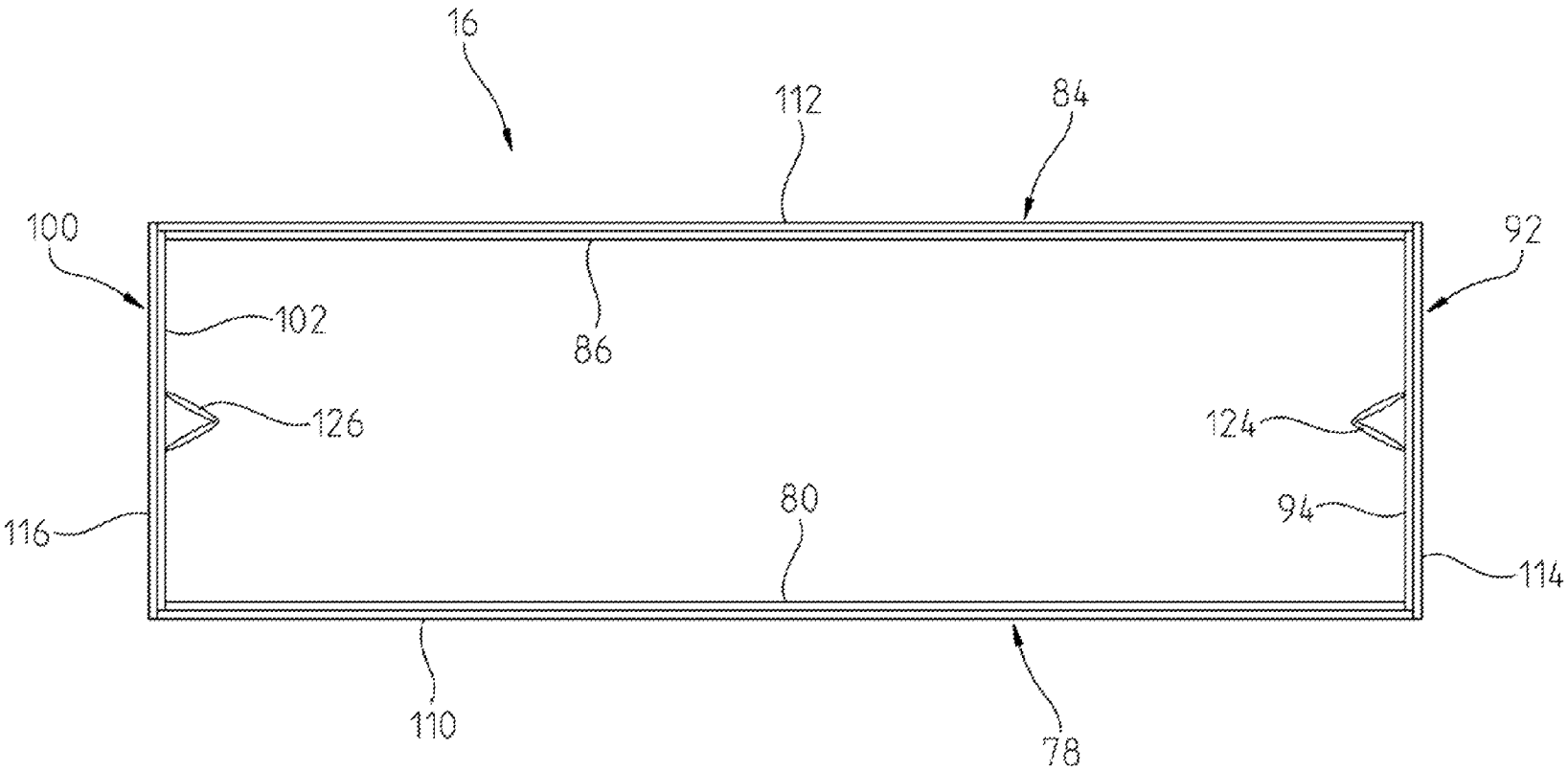
FIG. 9 is a top view of the upper member of the base portion of the cremation casket of the present invention, showing the upper member in its rise or expanded configuration.

The upper member 16 includes a first side panel 78 that extends generally along the first side of the upper member 16. The first side panel member includes a fixed panel portion 80 and a flap panel portion 82. The fixed panel portion 80 is disposed in the upper portion of the first side panel 78 and is so denominated as a fixed portion, because it maintains its orientation in a plane generally perpendicular to the plane of the base member 52 of the lower member 18, throughout its use. The flap panel 82 comprises the lower portion of the first side panel 78, and is connected to the fixed portion 80 about a scored, fold line 81 so that the flap portion 82 and fixed portion 80 are formed from the same piece of cardboard. The flap portion 82 is movable in its orientation between a storage position such as is shown in FIGS. 1A and 10, and a use position such as is shown in FIGS. 2A and 7.

The second side panel 84 is disposed in a generally parallel plane to the first side panel 78. The second side panel 84 includes a fixed panel portion 86 and a flap panel portion 88 similar to the first side panel 78.

First and second end panels 92, 100 are disposed at the first and second ends of the upper portion. The first and second end panel 92, 100 each include a respective fixed panel portion 94, 102 and flap panel portion 96, 104. Similar to the side panels 78, 84, the flap panel portions 96, 104 comprise the lower portion of the respective first and second end panels 92, 100, and are connected, to the end panel portions 94, 102 about scored fold lines so that the flap portions 96, 104 and fixed portions 94, 102 are formed from the same piece of cardboard. The flap portions 96, 104 are movable in their orientation between a storage position, wherein the flap portion 96, 104 extend in a plane generally perpendicular to the fixed portions 94, 102; and a use position wherein the flap portions 96, 104 are disposed in a plane generally coplanar with the fixed panel portions 94, 102.

Figure 10:
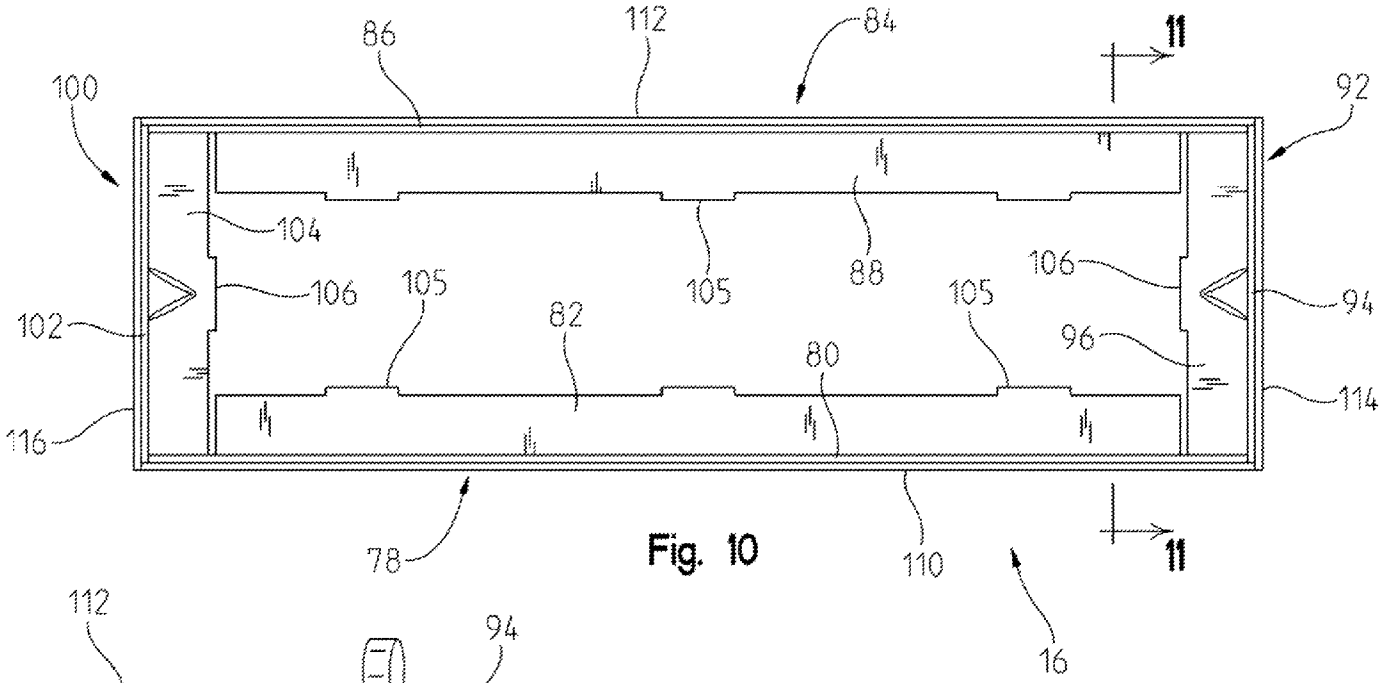
FIG. 10 is a top view of the upper member of the base portion of the cremation casket showing the upper member in is storage or shipping configuration.
Figure 11:
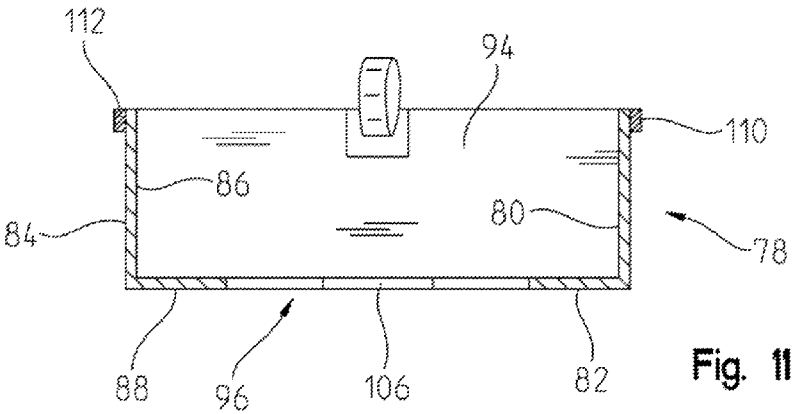
FIG. 11 is a sectional view taken along lines 11-11 of FIG. 10.

As best shown, in FIG. 10, each of the flap portions panel 82, 86 includes a series of side panel tabs 105 that are coupled to the first and second flap panel portions 82, 88 of the respective first and second side panels 78, 84. End panel tabs 106 are coupled to the lower portion of the flap portions 94 of the first end panel 92 and to the flap portion 104 of the second end panel 100, respectively. The side tab members 105 are sized and positioned to be insertable into the side slots 62 (FIG. 8) of the base panel 52 of the lower member 18, when, the flap portions 82, 84 are in their use position. Similarly, the end tabs 106 are sized, positioned and configured for insertion into the end slots 64 that are formed in the base panel 52 of the lower member 18 when the Hap portions 96, 104 are in their use position.

A perimetral reinforcing strip 109 extends around the outer surface of the first, second, third and fourth side panel members 78, 84, 92, 100 and is disposed generally adjacent to the top edge of the fixed portions 80, 86, 94, 102 of the side panels 78, 84, and end panels 92, 100. The reinforcing strip 109 is preferably made from a relatively stronger, rigid and more durable material, such as particle board, and has a thickness of about 0.5 inches, and a height of about 1.0 inches.

The reinforcing strip 109 helps to maintain the rigidity of the upper edge of the upper member 18, and maintains its correct size and configuration, so that the cremation container 10 can better be used in a viewing casket 10, and better inserted into the interior of the viewing casket shell. As will be described in more detail below, the reinforcing strip 109 can include an adhesive member such as a Velcro® brand hook-and-loop fastening material to enable the user to fasten an interior fabric piece to the reinforcing strip 109, to hold the fabric piece on to the strip 109 to provide appropriate decorative touches to the cremation casket.

Through the appropriate application, of such decorative material, the existence of the cardboard box-like cremation casket 10 disposed within the viewing casket can be obscured to a point where those attending the viewing will not realize that a cardboard box-like viewing cremation casket is actually being contained within a permanent, casket shell, but rather, will believe that the container actually comprises a permanent casket container.

The perimetral reinforcing strip 109 includes a first side reinforcing strip 110 adjacent the first side panel 78, a second reinforcing strip 112 disposed on the second side panel 84, a first end reinforcing strip 114 that is coupled to the first end panel 92 and a second end reinforcing strip 116 that is coupled to the second end panel 100.

First and second pulling straps 124, 126 are coupled to the interior surface of respective first and second end panels 92, 100 to facilitate the movement of the upper member 16 with respect to lower member 18. By holding on to the lower member (such, as by grabbing handles 46, 47) and pulling upwardly on the pulling straps 124, 126, one can easily move the upper member 16 in an expansionary direction into its use position.

Turning now to a comparison of FIGS. 1A and 2A next to each other, it will be noted that when in the use position (FIG. 2A) the upper member 16 extends upwardly and outwardly relative to lower member 18 a greater distance than it does when in the compressed storage configuration (FIG. 1A). This height difference is accomplished primarily due to the differing orientation of the flap members 82, 88. As shown in FIG. 1A when in the compressed or storage configuration, the flap members 82, 88, 96, 104 are disposed in a plane that is generally perpendicular to the plane of the fixed panel sections 80, 86, 94, 102 and parallel to the base member 52. As such, there is no contribution to the height of the overall casket 10 that is contributed by the flap portions 82, 88, 96, 104.

When the casket 10 is moved from the compressed or shipping position into the use configuration (as shown in FIG. 2A), the flap portions 82, 88, 96, 104 are moved into a position where they are disposed generally co-planarly with their respective fixed portions 80, 86, 94, 102. As such, the height of the casket 10, and in particular, the height of the upper portion 16 results from a combination of the length of the side panel portions 80, 86, 94, 102 and the flap portions 82, 88, 96, 104.

In a preferred exemplary embodiment, the height of the fixed portions of the side panels 80, 86, 94, 102 is approximately 8 inches, and the height of the flap portion 82, 88, 96, 104 is 4 inches. As such, the general height of the base 12 in the compressed mode is slightly larger (by the thickness of the base panel 52) than 8 inches, whereas the height of the base panel 16 in the use position is approximately slightly larger (by the thickness of the base panel 52) than 12 inches. As such, this results in a one-third compression in the height, and one-third compression, in the volume when the casket 10 is placid in its compressed configuration, when compared to the use configuration.

When in the use position (as best shown in FIG. 2A), the tabs 105 are inserted into the slots 62 that are formed in the base panel member 52. This helps to maintain the flap portions 82, 88 in their proper orientation, that is coplanar with their respective fixed portions, 80, 86. The same analogous event occurs with respect to the tab portions 106 of the respective flaps 96, 104.

Figure 5:
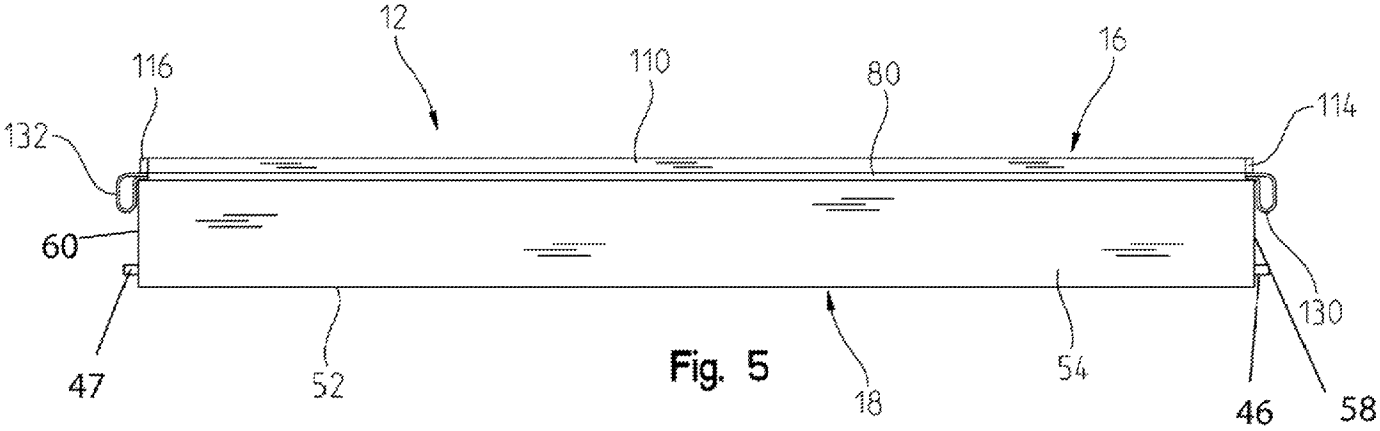
FIG. 5 is a long, side view of the lower member (also known as the container member) of the cremation casket of the present invention, showing the cremation casket in its compressed or storage configuration.
Figure 6:
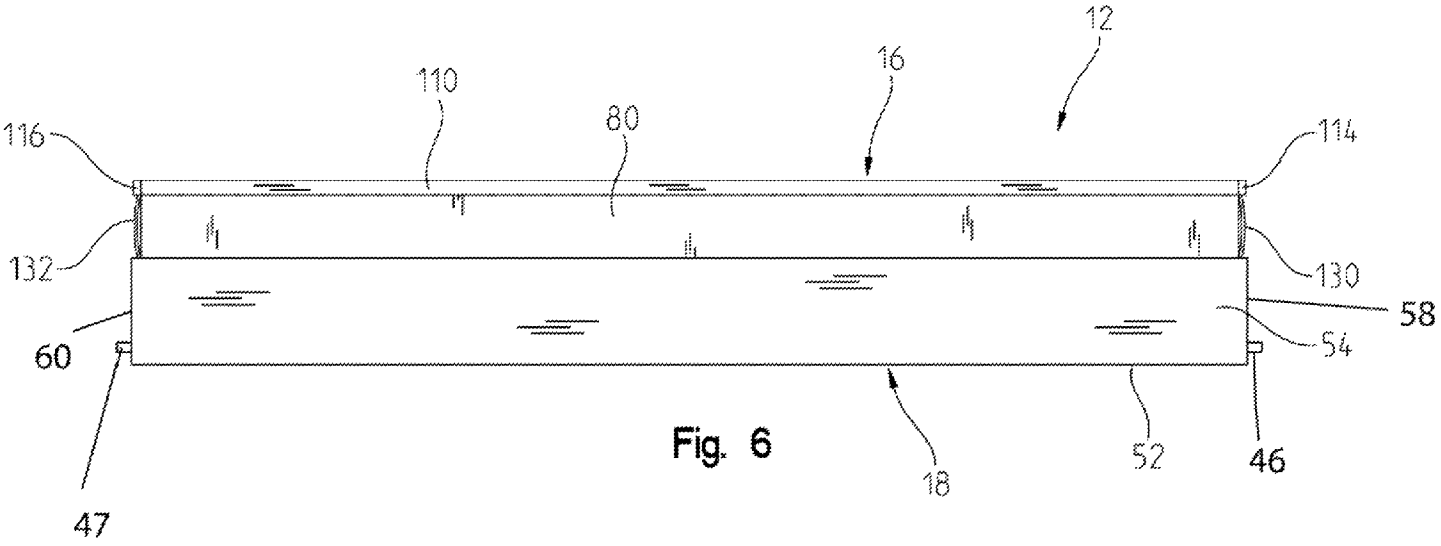
FIG. 6 is a long side view of the cremation casket lower or container member, similar to FIG. 5, except showing the lower member in its expanded, or "use" configuration.
Figure 5A:
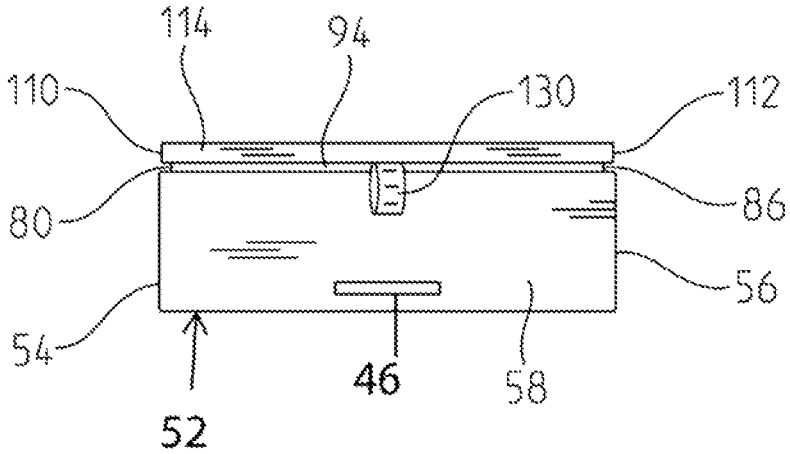
FIG. 5A is an end, or short side, view of the lower or container member of the cremation casket of the present invention, similar to FIG. 5 showing the cremation casket in its compressed or shipping configuration.
Figure 6A:
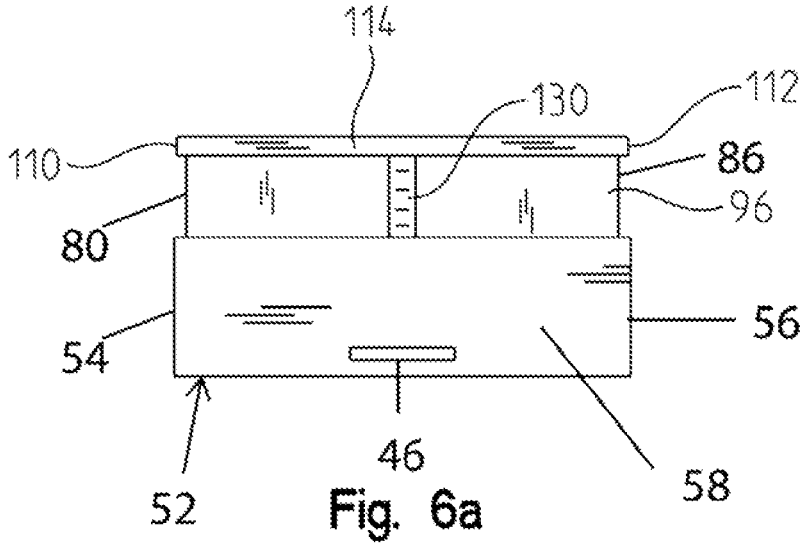
FIG. 6A is an end view (or short side view) of the cremation casket of the present invention, similar to FIG. 6, showing the cremation casket in its expanded or use configuration.

As is best shown in FIGS. 5A, 6 and 6A, first and second limit straps 130, 132 are disposed in each end of the base 12 of the cremation container 10. The limits straps 130, 132 are coupled between the upper member 16 and the lower member 18 to limit the relative expansionary movement of the upper member 16 relative to the lower member 18.

The limit straps 130, 132 limit the movement, so that when the base member 12 is moved between its compressed position, as shown in FIGS. 5 and 5A to its use or expanded position (FIGS. 6, 6A), the straps are allowed to extend to a certain point, shown in FIGS. 6 and 6A when the straps 130, 132 extend linearly (as opposed to folded) and are generally taut. When the straps 130, 143 are taut, the upper portion 16 has been moved to its furthest extent away from the lower portion 18.

The limit straps 130, 132 help also to prevent the upper and lower portions 16, 18 from getting separated, and help to hold the lower member 18 onto the upper member 16. For example, when a body is placed in the interior of the base 12, the weight of the body will press downwardly on the lower portion 18, since the body is ultimately resting on the tray 20, which itself is resting upon base panel member 52. If one were to grab the upper member 16 along the perimetral reinforcing rail (e.g. 109), the natural tendency would be that the weight of the body would pull the lower member 18 away from the upper member 16 to cause die two members 16, 18 to separate. Separation is prevented because the limiting straps 130, 132 connect and hold the lower member 18 to the upper member 16 so that separation can not occur.

As such, the straps 130, 132 should be strong enough so as to be able to not tear under the weight of the body. Additionally, the straps 130, 132 should be anchored securely enough to both the lower and upper portions 18, 16 to prevent the straps from becoming ripped out at their anchors. If desired, a reinforcing member such as a wood board or particle board can reinforce the panels to which the straps 130, 132 are connected.

The tray member 20 will now be described with respect to FIGS. 1A, 2A and 12-14.

Figure 14:
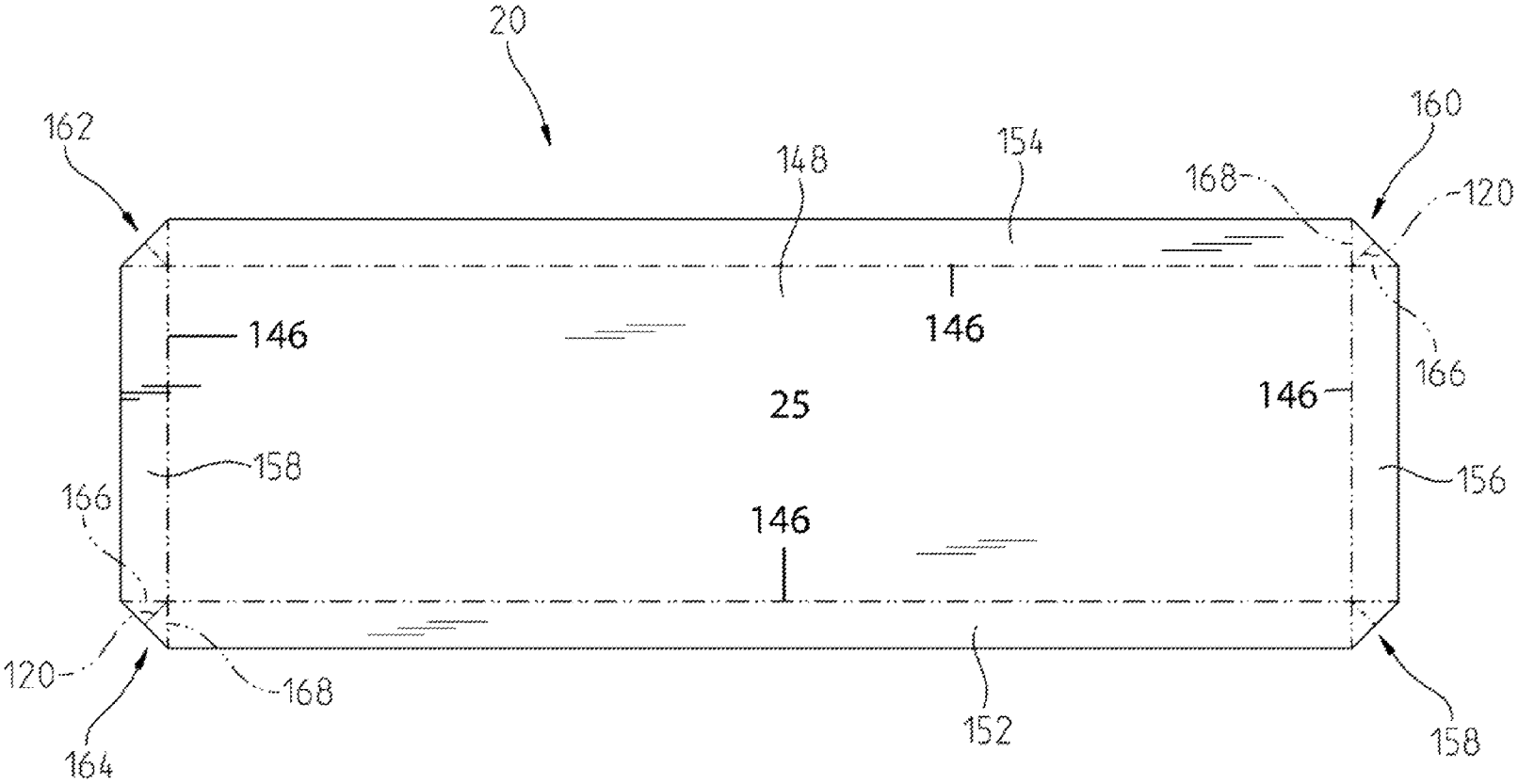
FIG. 14 is a view of the tray member flattened out, so that the tray and its side portions are placed in a coplanar relationship.

The tray member 20 is formed flat as shown in FIG. 14 from a single piece of cardboard. The tray member 20 includes a tray base panel 148 having an upper (or interior) surface 251 and a lower (or external) surface 417 that has a length and width (when folded) that are generally equal to, but perhaps, a slight bit smaller than the length and width of the base panel member 52 of the lower member 16. The base panel 148 includes a series of scored, fold lines 146, to separate the base panel 148 from a perimetral portion that includes a first foldable side flap 150 and a second foldable side flap 152. Additionally, the perimetral portion of the tray includes a pair of generally parallel fold lines 146 that are provided at either end for separating the base panel 148 from the first and second end flaps 154, 156.

The first and second side flaps 150, 152 and first and second end flaps 154, 156 are foldable, from a position wherein they are flat and thereby coplanar with the base panel 148 when they are formed as shown in FIG. 14, to a use position, where the flap portions 150, 152, 154, 156 are all disposed in planes that are generally perpendicular to the plane of the base panel member 148. When so disposed, the first and second side flap portions 150, 152 are disposed in generally parallel planes, as are the first and second end flaps 154, 156. The first and second end flaps 154, 156 are also disposed in a plane that is generally perpendicular to the plane of the side flaps 150, 152 and the tray base panel 148. When so folded, the flaps 150, 152, 154, 156 form a side wall for the tray 20.

Chamfered corners including first chamfered (beveled) corner 158, second chamfered corner 160, third chamfered corner 162 and fourth chamfered corner 164 are formed between adjacent side and end panel members. The chamfered corners 158-164 are each formed with three fold lines, including a first fold line 166 between the chamfered corner and an end panel member, a second fold line 168 that is disposed between the chamfered corner and the side panel member, and a third fold line 170 that is disposed at a diagonal between the first and second fold lines 166, 168, such that the fold lines all converge at a single point, at the convergence of the end flap, side flap and tray base panel.

Figure 12:
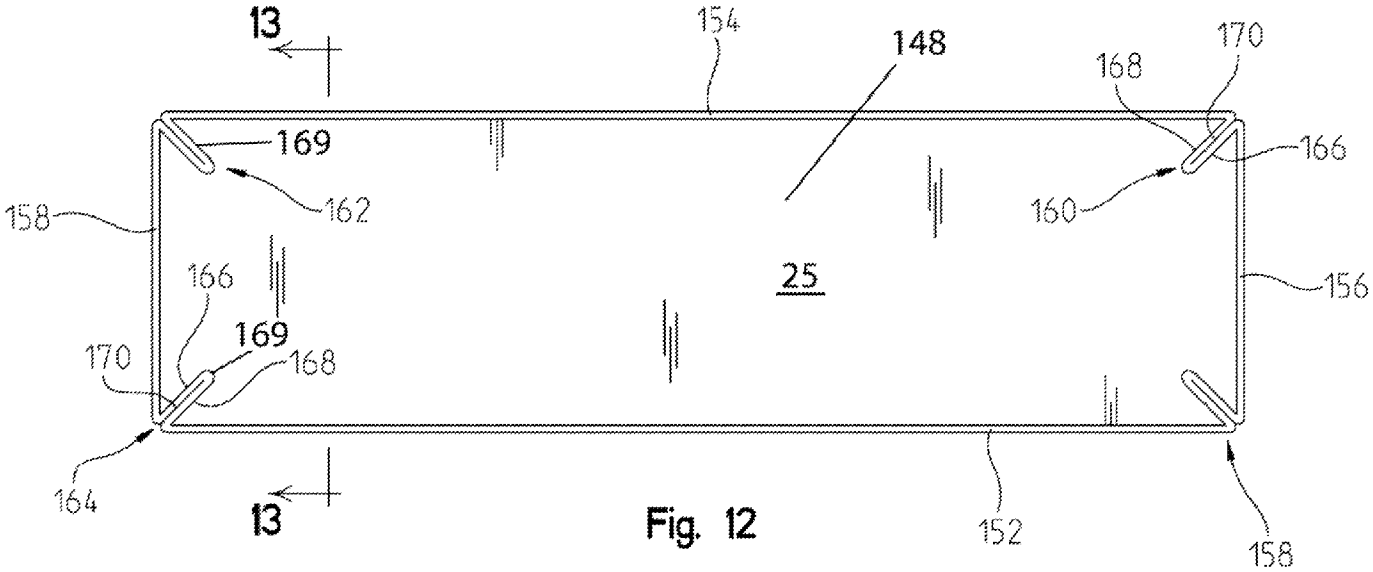
FIG. 12 is a top view of the body tray member that is a part of the base portion of the cremation casket.
Figure 13:
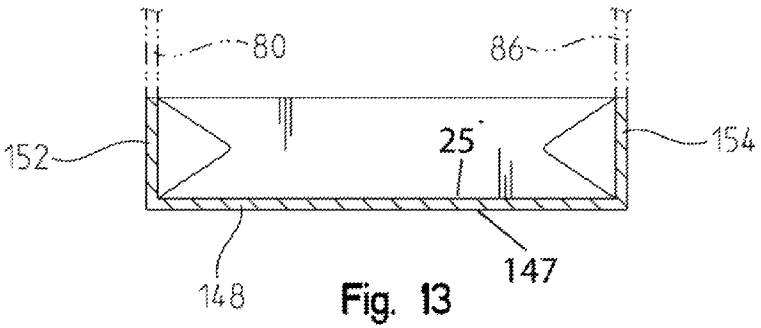
FIG. 13 is a sectional view taken along lines 13-13 of FIG. 12.

When so folded, the chamfered corners 158, 160, 162, 164 take on a configuration similar to that shown, in FIG. 12, wherein they provide a reinforcing, upstanding corner member for the tray panel. This reinforcing, upstanding corner member is useful, as shown in FIG. 13, since the reinforced corner can be placed under the side panels 88, 86 and/or end panels 94, 102 of the fixed portion of the upper portion, so that the corners 158, 160, 162, 164 can engage a downwardly facing edge 170 (FIG. 7) of upper member 16, to prevent it from collapsing downwardly and inwardly toward the base portion 18. This occurs because the upper edge of the corners engage the lower surface 170 of the fixed portions of the side panels 78, 84 and end panel 92, 100 members.

The tray 20 also aids in moving the lower 18 and upper 16 portion between the compressed and use position. Along with pulling up on the pull straps 124, 126 during movement into the use position, the user should also push downwardly on the upper surface 25 of the tray 20 to move the tray 20 toward the upper surface 21 of the base panel 52. In so doing, the relatively downward movement of the tray 20 helps to move the flap portions 82, 88, 96, 104 to pivot about their told lines from their generally perpendicular storage position, as shown in FIG. 1A to their use position as shown in FIG. 2A. This pushing downwardly on the tray 20 when coupled with the position of the side panels 152, 154 and end panels 156, 158 of the tray 20, helps to move the flap panels 82, 84, 92, 102 outwardly, so that the tabs 105, 106 are pushed into engagement, and inserted into the slots 62, 64 that are formed in the base panel 52 of the lower portion 18.

Figure 15:
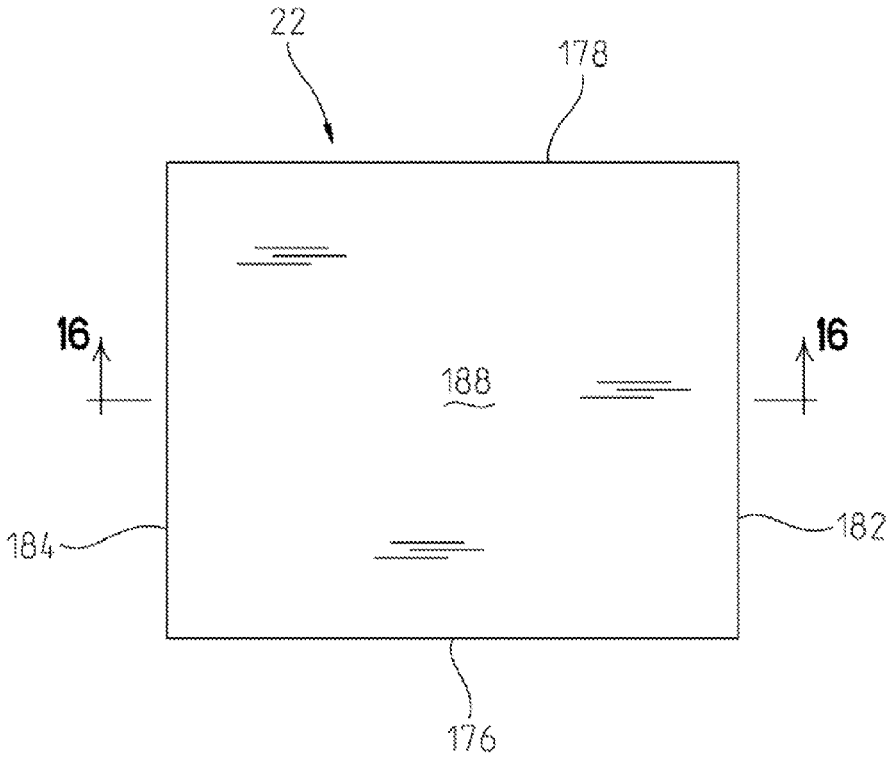
FIG. 15 is a top view of the riser member of the present invention.
Figure 16:
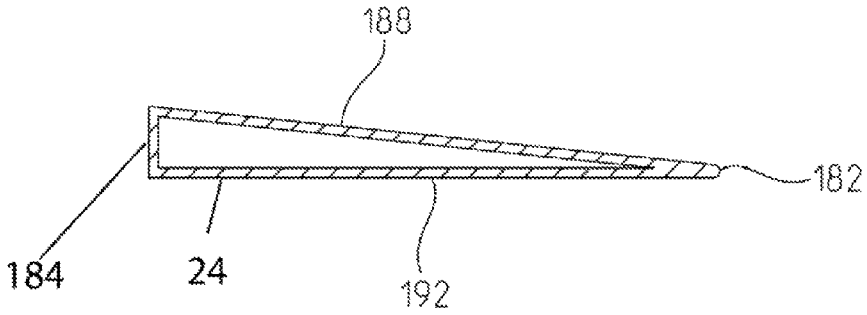
FIG. 16 is a sectional view taken along lines 16-16 of line 15.

The riser 22 is best shown in FIGS. 1A, 2A, 15 and 16. When viewed from the top as shown in FIG. 15, the riser 22 has a generally rectangular shape, having first and second side edges 176, 178 and first and second end edges 182, 184. The first and second side edges 176, 178 generally have a length that is approximately about one-half the length of the tray member 20, or less. The widths of the end panel members 182, 184 are generally equal to about the width of the tray 20, or just slightly less than the width of the tray 20.

A top panel member 188 is provided that is disposed at an angle relative to the base panel 192. This angle is such that the first end 182 of the riser has a smaller height than the second end 184, to give the riser a triangular, or wedge-like cross-sectional area. This helps to provide an elevating platform, for the torso of the deceased. Typically, the higher edge 189 of the riser is placed adjacent to the head receiving end of the cremation casket 10.

Figure 17:
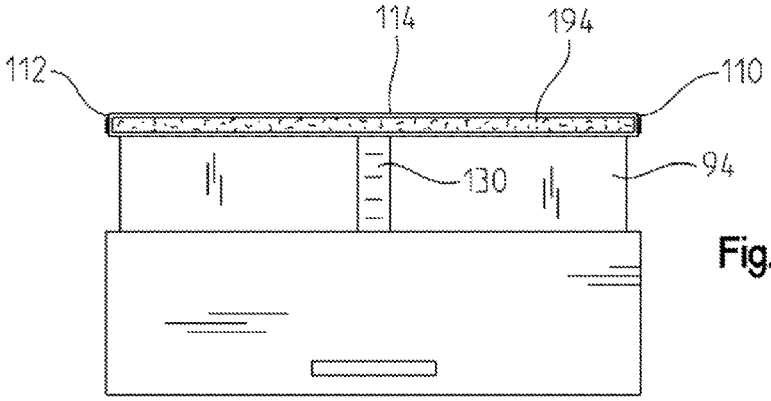
FIG. 17 is an end view of the base portion, including the lower and upper member of the present invention, showing a hook and eye fastener adhesive member coupled to the reinforcing strip that is coupled to the perimetrally upper surface of the upper member of the base portion.
Figure 18:
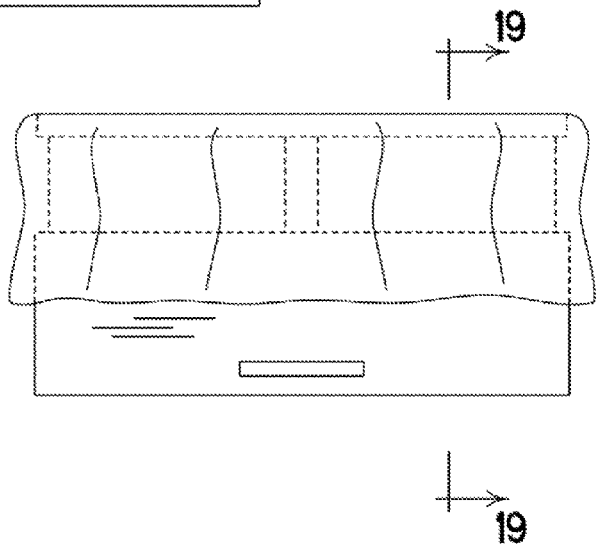
FIG. 18 is an end view of the cremation casket of the present invention showing a decorative cloth interior member coupled to the adhering member of the upper member of the base portion.
Figure 19:
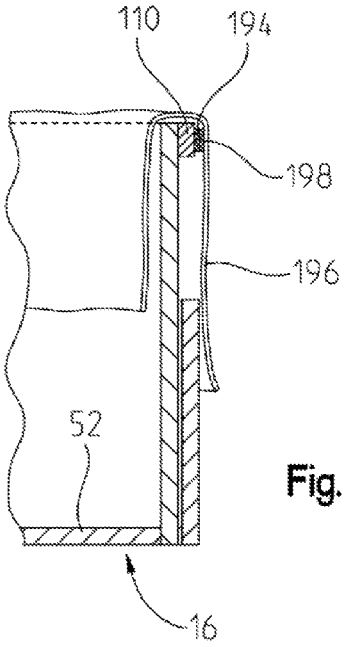
FIG. 19 is a sectional view taken along lines 19-19 of FIG. 18.

Turning now to FIGS. 17-19, it will be shown that a strip of adhesive material such as one element 194 of a Velcro-brand hook and loop fastener surface of the perimetral reinforcing member 109, such, as perimetral reinforcing member strips 114 or 110.

A drape-like material 196 can include its own complimentary strip of Velcro-brand hook-and-loop fastener material 198, so that the drape 116 can be coupled to the reinforcing member 110. When the drape 196 is properly positioned, it will extend over the top edge of the base 12, so as to effectively-disguise the base 12 and make it appear as if it is part of a permanent casket, rather than a cardboard cremation casket 10. As discussed above, various draping and interior members are typically made of fabric, and are well-known in the art, for properly outfitting the ulterior of a cremation casket to give it an appropriate aesthetic appearance. Depending on the whims of the user, the draping material 196 can be designed to be long enough to extend exteriorly of the base portion 16, or interiorly of the base portion. The goal in mind is to try to hide the viewing box or cremation casket body, so that its true nature as a low-cost, disposable container is hidden from relatives, friends and other mourners.

Having described the invention with respect to certain preferred embodiments, it will be appreciated that variations and modifications exist within the scope and spirit of the present invention, as limited, only by the law and the prior art.

What is claimed:

1. A cremation casket comprising a lid and a base, the base including a lower member and an upper member, the lower member including a base panel and at least a first and a second upstanding side wall panel, the first and second side wall panels being disposed in planes generally perpendicular to a plane in which the base panel is disposed, the upper member including first and second upstanding side wall panels disposed in planes generally parallel to the plane in which the first and second side wall panels of the lower member are disposed, and the upper member further including first and second flap panels movable between a storage position wherein the base has a relatively reduced height, and a use position, wherein the base has a relatively enlarged height, the first and second flap panels being disposed in a plane generally parallel to the base panel of the lower member in the storage position, and the first and second flap panels being disposed in a plane generally perpendicular to the base panel of the lower member in the use position, the first and second flap panels being coupled to the respective first and second side panels of the upper member, the first and second flap panels being engageable with the base panel of the lower member in one of the storage and use positions.

2. The cremation casket of claim 1 wherein the first and second flap panels are engageable with the base panel of the lower member for preventing the base from moving to the reduced height when the first and second flap panels are in the use position.

3. The cremation casket of claim 2 wherein the base panel includes a plurality of tab receiving apertures and the first and second flap panels include a plurality of tab members configured and positioned for being received in the tab receiving apertures for maintaining the first and second side panels in an engaged relation to the base panel thereby preventing the base from moving to the reduced height when the first and second flap panels are in the use position.

4. The cremation casket of claim 3 wherein the tab receiving apertures are positioned adjacent to the first and second side wall panels of the lower member for maintaining the first and second flap panels in a plane generally parallel to the planes in which the respective first and second side wall panels of the lower member are disposed.

5. The cremation casket of claim 4 wherein the first and second flap panels are unitarily formed with the respective first and second side wall panels of the upper member, and are hingedly movable relative to the respective first and second side wall panels about a fold line that permits the first and second flap panels to move between the storage position and the use position.

6. The cremation casket of claim 5 further comprising a strap member having a first end coupled to the lower member and a second end coupled to the upper member, the strap member having a predetermined length for limiting the movement of the lower and upper members in an expansionary direction to prevent the lower and upper members from becoming disengaged from each other.

7. The cremation casket of claim 5 further comprising a tray member having a base panel sized and configured to be placed adjacent to the base panel of the lower member for reinforcing the base panel of the base to reduce deformation when a body is placed in the cremation casket.

8. The cremation casket of claim 7 wherein the tray member includes first and second side wall panels for urging the first and second flap panels of the upper member into contact with the respective first and second side wall panels of the lower member.

9. The cremation casket of claim 8 wherein the base panel of the tray member includes a perimetral portion including the first and second side wall panels and a first end panel and a second end panel, the perimitral portion extending around the perimeter of the base panel and a perimetral fold line between the base panel and the perimetral portion to permit the perimetral portion to hingedly move about the fold line to assume aside wall orientation in one or more planes generally perpendicular to a plane in which the base panel resides, wherein the perimetral portion includes chamfered corner portions to facilitate folding of the corners when the perimetral portion is placed in the side wall orientation.

10. The cremation casket of claim 2 wherein the lid includes a top panel and at least two side panels sized for interiorly receiving the first and second side panels of the upper member, further comprising a reinforcing board member coupled to the first and second side panels of upper member of the base.

11. The cremation casket of claim 2 where the first and second side wall panels of the upper member of the base include a first side wall panel, a second side wall panel, a first end wall panel and a second end wall panel wherein the first and second end wall panels include respective first and second end wall flap panels movable between a storage position wherein the base has a relatively reduced height, and a use position wherein the base as a relatively enlarged height.

12. The cremation casket of claim 11 wherein the base panel includes a plurality of tab receiving apertures, and the flap panels of the first side panel, second side panel, first end panel and second end panel each include at least one tab member configured and positioned for being received by the tab receiving apertures for maintaining the flap panels of the first and second side panels and first and second end panels in an engaged relation to the base panel to maintain the relatively enlarged height of the base.

13. The cremation casket of claim 12 wherein the first and second upstanding side wall panels of the lower member include first and second end wall panels wherein the tab receiving apertures are positioned adjacent to the first and second side wall panels and the first and second end wall panels of the lower member for maintaining the first and second flap panels of the side wall panels and the first and second flap panels of the end panels of the upper member adjacent to and in a contacting and overlaying relationship with the respective first and second side panels and first and second end panels of the lower member.

14. The cremation casket of claim 2 wherein the first and second flap panels are unitarily formed with the respective first and second side wall panels of the upper member, and are hingedly movable with respect to the respective first and second side panel members about a fold line that permits the first and second flap panels to move between the storage position and the use position.

15. The cremation casket of claim 2 further comprising a strap member having a first end coupled to the lower member and a second end coupled to the upper member.

16. The cremation casket of claim 2 further comprising a tray member having a base panel sized and configured for placement adjacent to the base panel of the lower member for reinforcing the base panel to reduce deformation when a body is placed in the cremation casket.

17. The cremation casket of claim 16 wherein the tray member includes first and second side wall portions that are placeable against the first and second flap panels of the side panels of the upper member for urging the flap panels during transition between the storage and use position, into the use position wherein the first and second flap panels are disposed generally co-planarly with the respective first and second side panels of the upper member, and in parallel planes with the respective first and second side panels of the lower member.

18. The cremation casket of claim 1 wherein the base panel includes a plurality of tab receiving apertures and the first and second flap panels include a plurality of tab members configured and positioned for being received in the tab receiving apertures for maintaining the first and second side panels in an engaged relation to the base panel.

19. A cremation casket comprising a lid and a base, the base including an interior for receiving a body, the base including a lower member and an upper member, the lower member including a base panel and first and second upstanding side wall panels disposed in a plane generally perpendicular to the plane of the base panel, the upper member including first and second upstanding side wall panels, the first and second side wall panels including respectively, first and second fixed panels fixedly disposed in planes generally parallel to the first and second side panels of the lower member, the first and second side panels of the upper member including respective first and second flap panels hingedly coupled to the respective first and second fixed panels, the first and second flap panels being movable between a relatively reduced volume storage position wherein the first and second flap panels are disposed in a plane generally perpendicular to the respective first and second fixed panels, and a relatively enlarged volume use position wherein the first and second flap panels are disposed in a plane generally parallel to the respective first and second fixed panels of the upper member.

20. The cremation casket of claim 19 wherein the base panel of the lower member includes a plurality of tab receiving apertures and the first and second flap panels include tab members sized and positioned for being received in the tab receiving apertures for maintaining the flap panels in engagement with the lower member for maintaining the cremation casket in the enlarged volume use position.

21. The cremation casket of claim 20 further comprising a strap member having a first end portion coupled to the lower member and a second end coupled to the upper member, the strap member having a predetermined fixed length for limiting movement of the lower and upper members in an expansionary direction to prevent the lower and upper member from becoming disengaged from each other, and a tray member having a base panel sized and configured to be placed adjacent to, and in a parallel plane with the base panel of the lower member for reinforcing the base panel to reduce deformation of the base panel when a deceased is placed in the casket, the tray member including first and second side wall panels for engaging the respective first and second flap panels for urging the first and second flap panels into contact with the respective first and second side panels of the lower member and into a position wherein the first and second flap panels are disposed in planes parallel with the respective first and second side panels of the lower member.

* * * * *